US006239394B1

(12) United States Patent
Wu

(10) Patent No.: US 6,239,394 B1
(45) Date of Patent: May 29, 2001

(54) WATERPROOF SWITCH DEVICE

(75) Inventor: Ming-Hui Wu, Taipei Hsien (TW)

(73) Assignee: Shih Jiuh Corp., Hsin-Tien (TW)

( * ) Notice: Subject to any disclaimer, the term of this patent is extended or adjusted under 35 U.S.C. 154(b) by 0 days.

(21) Appl. No.: 09/418,613

(22) Filed: Oct. 15, 1999

(51) Int. Cl.[7] ..... H01H 35/18; H01H 9/04

(52) U.S. Cl. ..... 200/302.1; 200/61.2; 200/81 R; 200/84 R

(58) Field of Search ..... 200/61.2, 61.21, 200/81 R, 81.9 R, 82 R, 82 C, 82 A, 84 R, 84 A, 84 B, 293, 302.1, 302.3, 303; 73/290 R, 305, 314, 317, 319, 322.5

(56) References Cited

U.S. PATENT DOCUMENTS 4,239,947 * 12/1980 Breitung et al. ..... 200/61.89
4,725,700 * 2/1988 Zoludow ..... 200/81.9 R
4,757,305 * 7/1988 Peso ..... 340/624
5,010,218 * 4/1991 Reimers ..... 200/84 R

* cited by examiner

*Primary Examiner*—Michael Friedhofer
(74) *Attorney, Agent, or Firm*—Ohlandt, Greeley, Ruggiero & Perle, L.L.P.

(57) ABSTRACT

A waterproof switch device is for use with an elongated actuator in a water containing chamber, and includes a top cover wall spaced apart from the chamber and having a bore for movement of the actuator in response to a reach of a predetermined water level. A rear wall and two engaging walls are integrally formed with the top cover wall to form an inner major surface. A groove forming wall is integrally formed with and extends from the inner major surface, and is spaced apart from the top cover wall so as to define an inserting groove therebetween. A switch body is mounted on and is spaced apart from the inner major surface, and has an actuated stud to make a switching action when depressed. A lever includes an actuating end disposed between the groove forming wall and the actuated stud, and a force transmitting end disposed under and moved downward by the elongated actuator to cause the actuating end to depress the actuated stud. A front cover includes a front major wall with two engaging edges fitted with the engaging walls, and an intervening wall inserted into the inserting groove and sandwiched between the lower major surface and the groove forming wall, thereby blocking the water dripping or creeping over the bore from falling directly downwards to the inner major surface.

6 Claims, 5 Drawing Sheets

WATERPROOF SWITCH DEVICE

BACKGROUND OF THE INVENTION

1. Field of the Invention

This invention relates to a waterproof switch device, more particularly to a waterproof switch device for use with an elongated actuator which is disposed in a working liquid containing chamber and which extends downwardly and outwardly of and which is movable in an upright direction in response to a reach of a predetermined level of the working liquid containing chamber.

2. Description of the Related Art

Referring to FIG. 1, a conventional switch device 20 is shown for use with an elongated actuator 12. The elongated actuator 12 is mounted in a water containing chamber 10 above a seat member 11, and has an actuating rod 121 which extends downwardly and outwardly of the seat member 11 and which is movable in an upright direction in response to a reach of a predetermined water level of the water containing chamber 10. An elongate receiving member 111 is disposed under the seat member 11 for receiving the actuating rod 121. A retaining arm 112 is disposed under the seat member 11 and has a positioning recess 113.

The switch device 20 includes a casing 21, a front cover 22, and a switch body 23. The casing 21 has a top cover wall 212 with a positioning block 211 to engage the positioning recess 113 and a bore 213 for passage of the actuating rod 121, two lateral walls with fastening blocks 214 disposed thereon, and three positioning protrusions 216,217 for retaining the switch body 23 in the casing 21. The switch body 23 has an actuated stud 232 to make a switching action when depressed. A lever 231 has an actuating end to depress the actuated stud 232 and a force transmitting end 231 which extends from the actuating end through a notch 215 to be disposed under the bore 213 so as to be moved downward by an actuating portion 1211 of the actuating rod 121 to cause the actuating end of the lever 231 to depress the actuated stud 232. The front cover 22 has two lateral edges with fastening holes 221 for engaging securely the fastening blocks 214 of the casing 21.

Water in the water containing chamber 10 tends to flow along the inner peripheral wall of the elongate receiving member 111, drip or creep over the top cover wall 212 and an inner peripheral portion of the bore 213, and fall downwards to enter the casing 21, thereby resulting in wetting of the switch body 23.

SUMMARY OF THE INVENTION

The object of the present invention is to provide a waterproof switch device which can block water from entering a switch casing so as to prevent a switch body from being moistured.

According to this invention, the waterproof switch device includes a top cover wall with upper and lower major surfaces opposite to each other, and an inner peripheral portion defining a bore, and adapted to be suspended and spaced apart from a working liquid containing chamber such that an elongated actuator extends through the bore downwardly and outwardly of and is movable relative to the lower major surface. A rear wall is integrally formed with the top cover wall and rearwardly of the bore, and extends downwardly to form an inner major surface. Right and left engaging walls are integrally formed with and extend from the rear wall so as to cooperate with the rear wall to confine the inner major surface. A groove forming wall is integrally formed with and extends from the inner major surface, and is spaced apart from the lower major surface so as to define therebetween an inserting groove. The groove forming wall has right and left lateral edges distal and proximate to the inner peripheral portion of the top cover wall.

A switch body is mounted on and is spaced apart from the inner major surface, and rightwardly of the left lateral edge of the groove forming wall. The switch body includes an actuated stud disposed in and extending outwardly of the switch body to spacedly face the groove forming wall so as to make a switching action when the actuated stud is depressed.

A lever includes an actuating end disposed between the groove forming wall and the actuated stud so as to depress the actuated stud downwards, and a force transmitting end extending from the actuating end beyond the left lateral edge of the groove forming wall to be disposed under and moved downward by the elongated actuator, thereby causing the actuating end to depress the actuated stud.

A front cover includes a front major wall with an upper edge, right and left engaging edges opposite to each other and fitted respectively with the right and left engaging walls, and an intervening wall extending from the upper edge to be inserted into the inserting groove and sandwiched between the lower major surface and the groove forming wall, thereby blocking the water dripping or creeping over the inner peripheral portion from falling directly downwards to the inner major surface.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
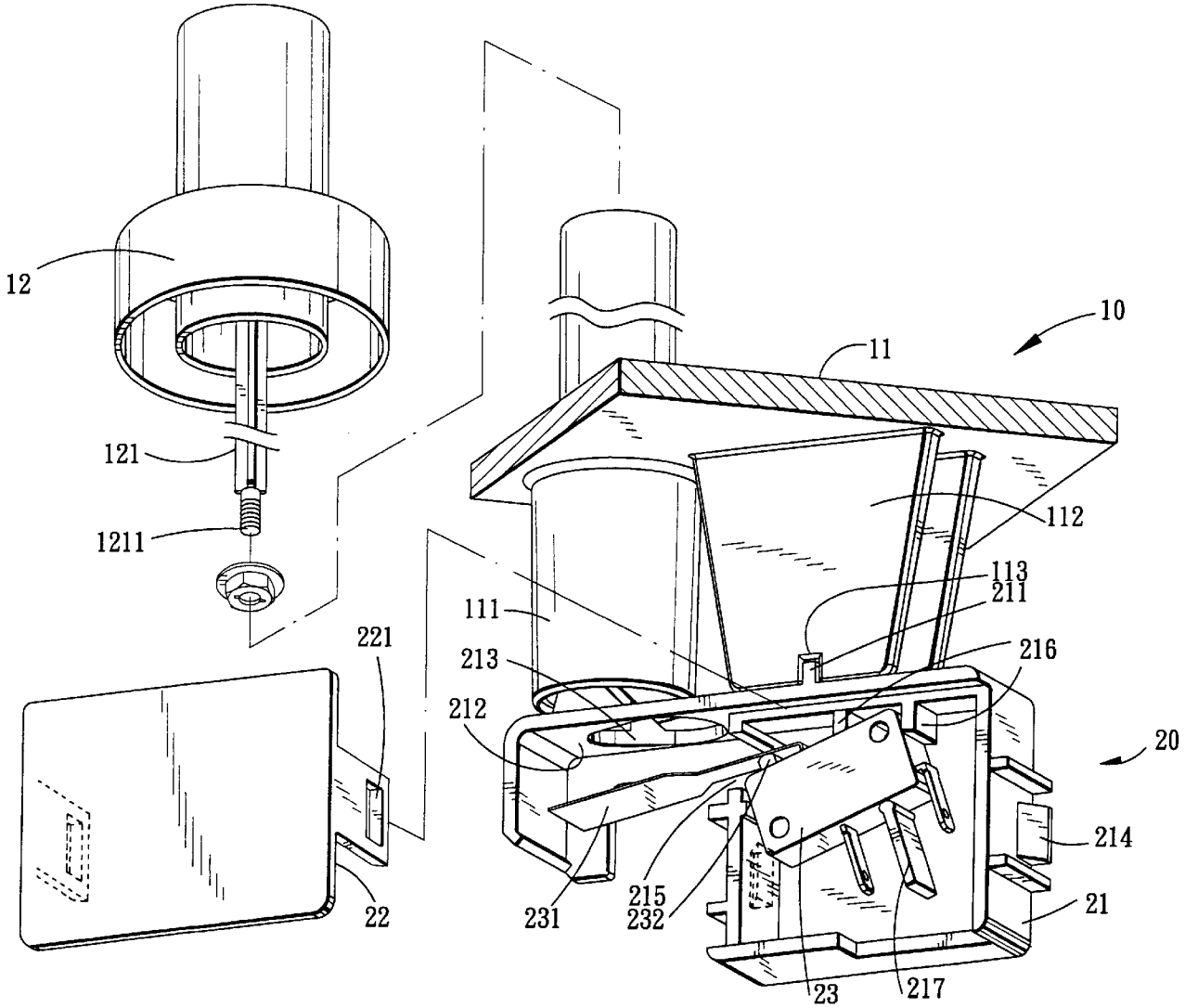
PRIOR ART FIG. 1
FIG. 1 is an exploded perspective view of a conventional switch device for use with an elongated actuator in a working liquid containing chamber.
Figure 2:
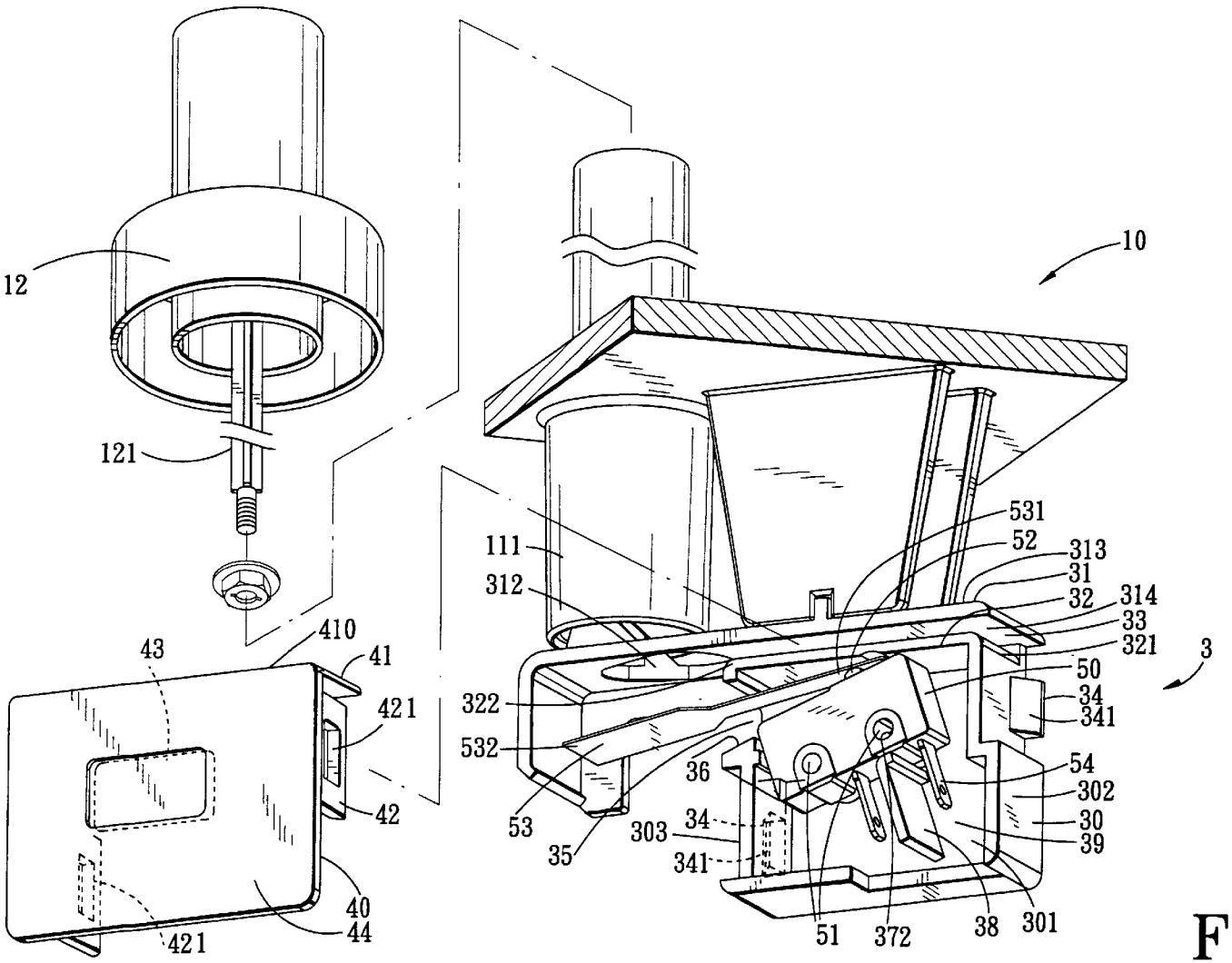
FIGS. 2 and 3 are exploded perspective views of a preferred embodiment of a waterproof switch device according to this invention for use with an elongated actuator in a working liquid containing chamber.
Figure 3:
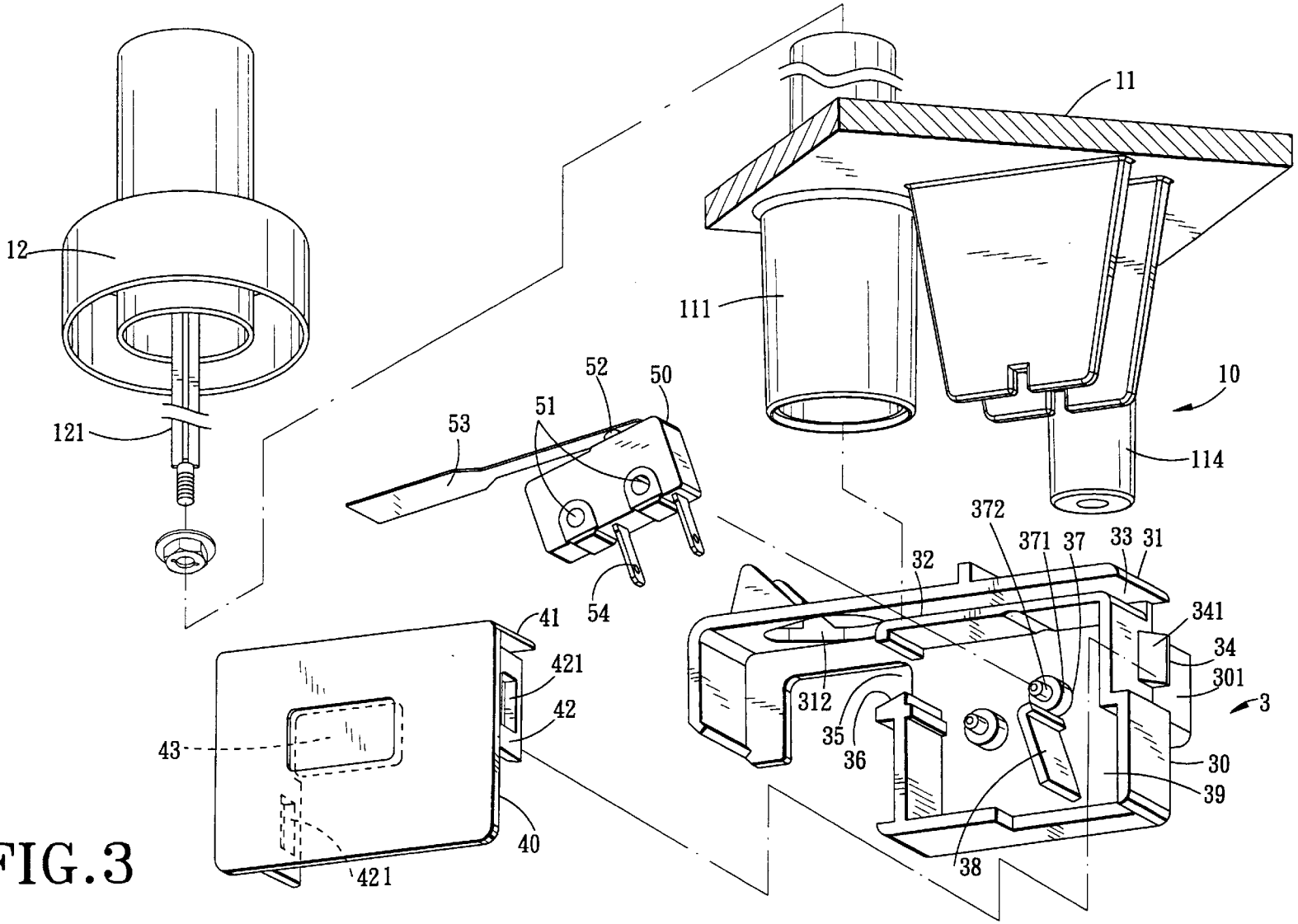

Referring to FIGS. 2 and 3, the preferred embodiment of the waterproof switch device 3 according to the present invention is shown for use with an elongated actuator 12. The elongated actuator 12 is disposed in a retaining member 111 of a working water containing chamber 10, and extends downwardly and outwardly of and movable in an upright direction relative to the working water containing chamber 10 in response to a reach of a predetermined water level of the working water containing chamber 10. The waterproof switch device 3 includes a casing 30, a front cover 40, and a switch body 50.

Figure 4:
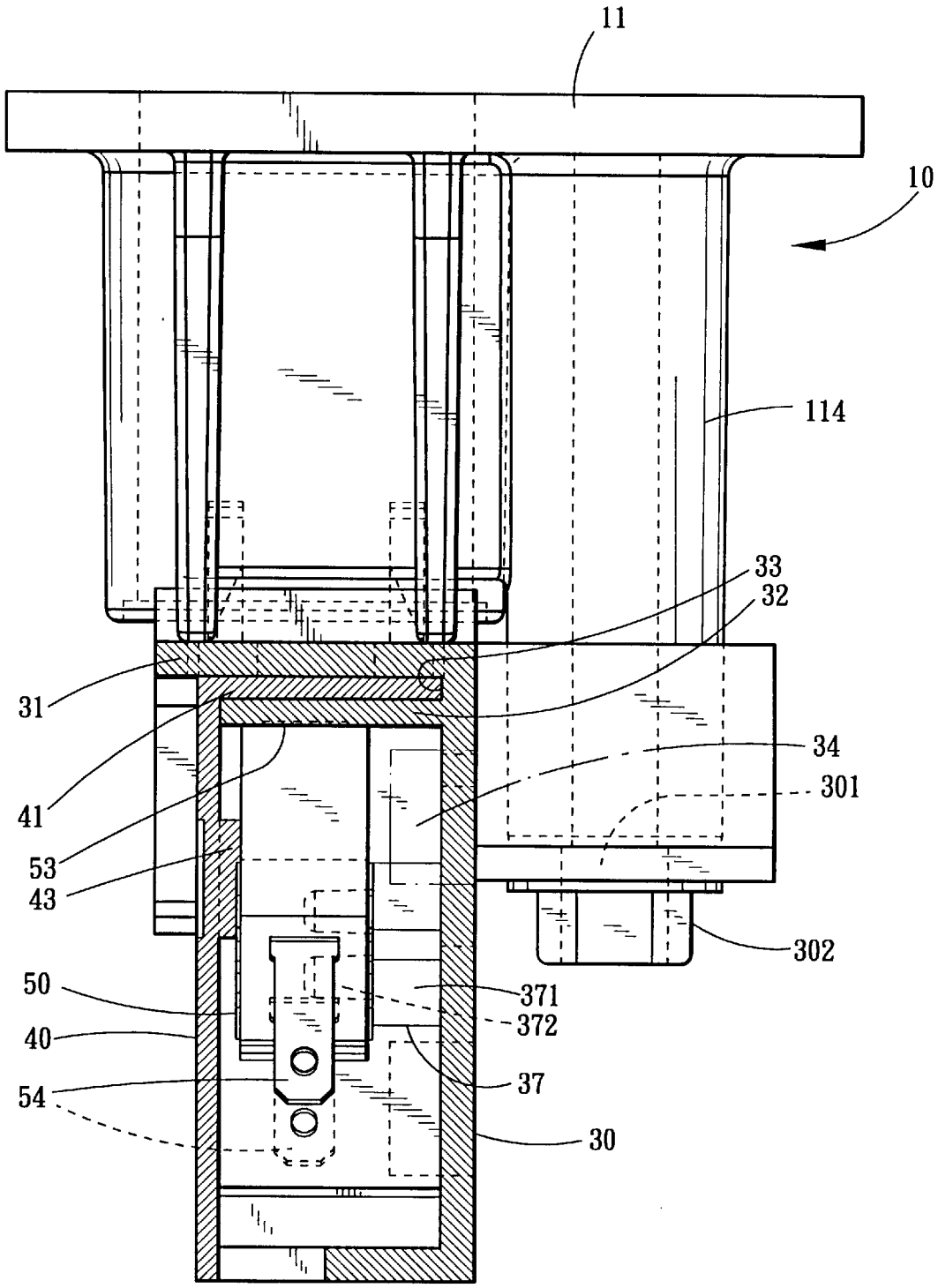
FIG. 4 is a sectional view of the preferred embodiment in FIG. 2.

The casing 30 includes a top cover wall 31, a rear wall 301, right and left engaging walls 302,303, and a groove forming wall 32. With reference to FIGS. 3 and 4, a threaded lock portion 301 is disposed rearwards of the rear wall 301 to engage securely a threaded lock post 114 of a seat member 11 by a screw fastener 302. The top cover wall 31 has upper and lower major surfaces 313,314 opposite to each other in a first transverse direction, and an inner peripheral portion which defines a bore 312 extending from the upper major surface 313 to the lower major surface 314. The top cover member 31 is adapted to be suspended and spaced apart from the working water containing chamber 10. As such, an actuating rod 121 of the elongated actuator 12 extends through the bore 312 downwardly and outwardly of and is movable in the first transverse direction relative to the lower major surface 314 when the elongated actuator 12 is moved in the upright direction.

The rear wall 301 has an upper edge which is integrally formed with the top cover wall 31 and rearwardly of the bore 312 in a second transverse direction that is transverse to the first transverse direction. The rear wall 301 further extends downwardly from the top cover wall 31 in the first transverse direction to form an inner major surface 39.

The right and left engaging walls 302,303 are integrally formed with and extend from the rear wall 301 in the second transverse direction to be spacedly opposed to each other in a longitudinal direction that is transverse to both the first and second transverse directions so as to cooperate with the rear wall 301 to confine the inner major surface 39. The right and left engaging walls 302,303 have fastening blocks 34 provided thereon.

The groove forming wall 32 is integrally formed with and extends from the inner major surface 39 in the second transverse direction, and is spaced apart from the lower major surface 314 so as to define therebetween an inserting groove 33. The groove forming wall 32 includes right and left lateral edges 321,322 opposite to each other in the longitudinal direction and distal and proximate to the inner peripheral portion.

A partition wall 38 and a pair of retaining stems 37 are formed on the inner major surface 39. Each retaining stem 37 includes a larger portion 371 which is secured on the inner major surface 39, and a smaller portion 372 which extends forwardly from the larger portion 371.

The switch body 50 has a pair of retaining holes 51 of such a dimension as to engage the smaller portions 372 of the retaining stems 37 so as to be mounted on and spaced apart from the inner major surface 39 in the second transverse direction and rightwardly of the left lateral edge 322 of the groove forming wall 32 in the longitudinal direction. The switch body 50 includes an actuated stud 52 which is disposed in and which extends outwardly of the switch body 50 to spacedly face the groove forming wall 32 in the first transverse direction. The actuated stud 52 can make a switching action when depressed in the first transverse direction. A pair of terminal prongs 54 are disposed outwardly of the switch body 50 opposite to the actuated stud 52.

A lever 53 includes an actuating end 531 which is disposed between the groove forming wall 32 and the actuated stud 52 so as to depress the actuated stud 52 to move in the first transverse direction, and a force transmitting end 532 which extends from the actuating end 531 in the longitudinal direction and beyond the left lateral edge 322 of the groove forming wall 32 via a passage 35 defined between the left lateral edge 322 and an upper edge of the left engaging wall 303. The lever 53 is disposed under and is moved downward by the elongated actuator 12, thereby causing the actuating end 531 to depress the actuated stud 52.

The front cover 40 includes a front major wall 44 with an upper edge 410, right and left engaging edges 42 opposite to each other. The right and left engaging edges 42 have two fastening holes 421. When the front cover 40 is brought towards the casing 30 in the second transverse direction, the right and left engaging edges 42 are fitted respectively with the right and left engaging walls 302,303 in such a manner that the fastening blocks 34 engage the respective fastening holes 421 by the guidance of guiding surfaces 341 of the fastening blocks 34 so as to warrant the engagement of the right and left engaging edges 42 and the right and left engaging walls 302,303, respectively. With reference to FIG. 4, an intervening wall 41 is disposed to extend from the upper edge 410 in the second transverse direction to be inserted into the inserting groove 33 and sandwiched between the lower major surface 314 of the top cover wall 31 and the groove forming wall 32. The front cover 40 further includes a projecting portion 43 which extends rearwardly from the front major wall 44 for abutting against the switch body 50 when the right and left engaging edges 42 are fitted with the right and left engaging walls 302,303, respectively.

Thus, the working water which drips or creeps over the inner peripheral portion can be blocked from falling directly downwards to the inner major surface 39 of the casing 30. In addition, the upper edge of the left engaging wall 303 is formed with a guiding wall surface 36 which faces the left lateral edge 322 and which inclines downwardly and leftwardly of the left lateral edge 322 so as to steer the water dripping from the left lateral edge 322 away from the inner major 39 through the passage 35.

Figure 5:
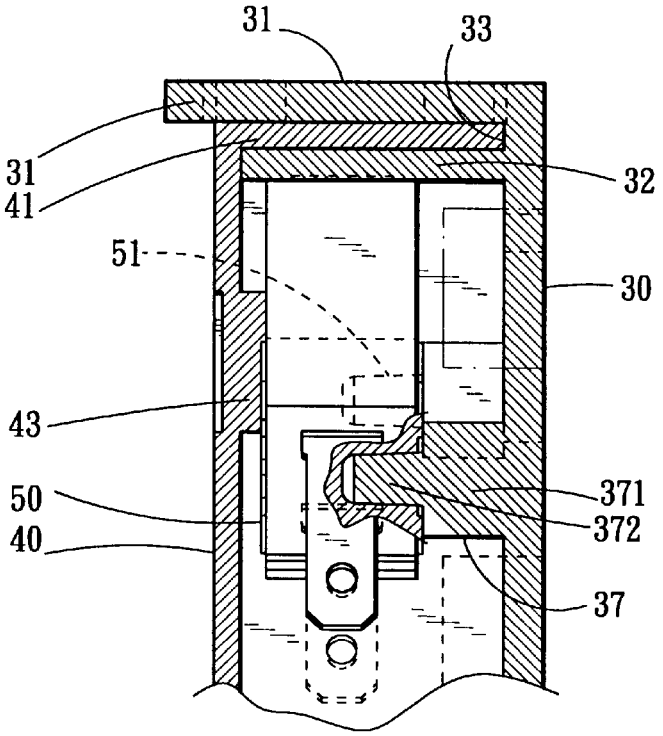
FIG. 5 is a sectional view of a portion of the preferred embodiment.

Moreover, as shown in FIG. 5, the switch body 50 is spaced apart from the inner major surface 39, thereby enhancing the waterproofing effect.

Figure 6:
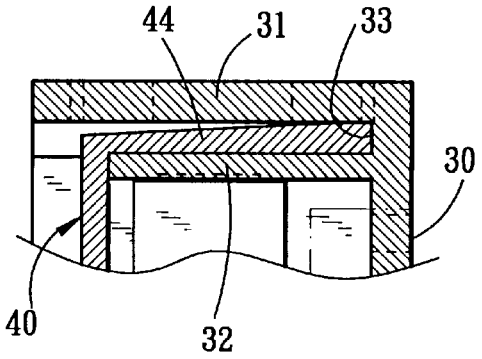
FIG. 6 is a sectional view of a portion of the waterproof switch device according to another preferred embodiment.

Referring to FIG. 6, the intervening wall 44 of the front cover 40 according to another preferred embodiment of this invention has a thickness that increases gradually in the first transverse direction from the left engaging edge 322 toward the right engaging edge 321 of the groove forming wall 32 so as to facilitate further blocking of the water falling to the inner major surface 39.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A waterproof switch device for use with an elongated actuator which is disposed in a working liquid containing chamber and which extends downwardly and outwardly of and which is movable in an upright direction relative to the working liquid containing chamber in response to a reach of a predetermined level of the working liquid containing chamber, said waterproof switch device comprising:

a top cover wall having upper and lower major surfaces opposite to each other in a first transverse direction, and an inner peripheral portion defining a bore that extends from said upper major surface to said lower major surface, said top cover member being suspended and spaced apart from the working liquid containing chamber, and being disposed such that the elongated actuator extends through said bore downwardly and outwardly of and is movable in the first transverse direction relative to said lower major surface when the elongated actuator is moved in the upright direction;

a rear wall with an upper edge disposed to be integrally formed with said top cover wall and rearwardly of said bore in a second transverse direction which is transverse to the first transverse direction, said rear wall further extending downwardly from said top cover wall in the first transverse direction to form an inner major surface;

right and left engaging walls disposed to be integrally formed with, and extending from said rear wall in the second transverse direction to be spacedly opposed to each other in a longitudinal direction which is transverse to both the first and second transverse directions so as to cooperate with said rear wall to confine said inner major surface;

a groove forming wall disposed to be integrally formed with, and extending from said inner major surface in the second transverse direction, and spaced apart from said lower major surface so as to define therebetween an inserting groove, said groove forming wall including right and left lateral edges opposite to each other in the longitudinal direction and distal and proximate to said inner peripheral portion;

a switch body mounted on and spaced apart from said inner major surface in the second transverse direction, and rightwardly of said left lateral edge of said groove forming wall in the longitudinal direction, said switch body including an actuated stud disposed in and extending outwardly of said switch body to spacedly face said groove forming wall in the first transverse direction so as to make a switching action when said actuated stud is depressed in the first transverse direction;

a lever including an actuating end disposed between said groove forming wall and said actuated stud so as to depress said actuated stud to move in the first transverse direction, and a force transmitting end extending from said actuating end in the longitudinal direction and beyond said left lateral edge of said groove forming wall, and disposed under and moved downward by the elongated actuator to thereby cause said actuating end to depress said actuated stud; and a front cover including a front major wall with an upper edge, right and left engaging edges opposite to each other and fitted respectively with said right and left engaging walls when said front cover is brought towards said right and left engaging walls respectively in the second transverse direction, and an intervening wall disposed to extend from said upper edge in the second transverse direction to be inserted into said inserting groove and sandwiched between said lower major surface and said groove forming wall thereby blocking the working liquid dripping or creeping over said inner peripheral portion of said top cover wall from falling directly downwards to said inner major surface.

2. The waterproof switch device as claimed in claim 1, wherein said left engaging wall has an upper edge which is spaced apart from said left lateral edge in the first transverse direction to define a passage for extension of said force transmitting end, and which is formed with a guiding wall surface facing said left lateral edge and inclining downwardly and leftwardly of said left lateral edge so as to steer the working liquid dripping from said left lateral edge away from said inner major surface through said passage.

3. The waterproof switch device as claimed in claim 1, further comprising a pair of retaining stems which are disposed on and which extend forwardly from said inner major surface in the second transverse direction, and which are spaced apart from each other in the longitudinal direction, said switch body further having a pair of retaining holes of such a dimension as to sleeve respectively on said retaining stems and be spaced apart from said inner major surface.

4. The waterproof switch device as claimed in claim 3, wherein said front cover further includes a projecting portion extending rearwardly from said front major wall for abutting against said switch body when said right and left engaging edges of said front cover are fitted with said right and left engaging walls, respectively.

5. The waterproof switch device as claimed in claim 1, wherein said intervening wall of said front cover has a thickness that increases gradually in the first transverse direction from said left engaging edge toward said right engaging edge.

6. The waterproof switch device as claimed in claim 1, further comprising a pair of fastening members each disposed between a respective one of said right and left engaging walls and a respective one of said right and left engaging edges so as to warrant the engagement of said right and left engaging edges and said right and left engaging walls, respectively.

* * * * *